United States Patent [19]

Hirtle

[11] 3,968,597

[45] July 13, 1976

[54] CLOSURE SEAL AND METHOD

[75] Inventor: Parker W. Hirtle, Lexington, Mass.

[73] Assignee: Bolt Beranek and Newman, Inc., Cambridge, Mass.

[22] Filed: Jan. 13, 1972

[21] Appl. No.: 217,534

[52] U.S. Cl. ..... 49/477; 49/306

[51] Int. Cl.[2] ..... E06B 7/16

[58] Field of Search ..... 49/477, 303, 306

[56] References Cited

UNITED STATES PATENTS

| | | | |
|---|---|---|---|
| 3,100,918 | 8/1963 | Coverley | 49/477 |
| 3,110,065 | 11/1963 | Dennis | 49/477 |

FOREIGN PATENTS OR APPLICATIONS

| | | | |
|---|---|---|---|
| 986,854 | 4/1951 | France | 49/477 |
| 729,980 | 5/1955 | United Kingdom | 49/477 |

*Primary Examiner*—Philip C. Kannan

*Attorney, Agent, or Firm*—Rines and Rines

[57] ABSTRACT

This disclosure deals with a novel closure seal embodying the compression of a region of a tubular member adjacent a door mounting edge during closure of the door, to pump air into a communicating region of the member disposed along the bottom edge of the door, to expand the same into a seal upon total closure of the door.

2 Claims, 3 Drawing Figures

CLOSURE SEAL AND METHOD

The present invention relates to closure sealing methods and apparatus, being more particularly directed to acoustic and similar gaskets for the bottom edges of doors and the like, automatically operative and retractable upon the respective closing and opening of the door.

In my earlier U.S. Pat. Nos. 3,518,793 and 3,555,734, there are disclosed bubble-like tubular gaskets adapted to compress upon the closure of a door to effect acoustic seals between the peripheral edges of the door and its frame. While these have been found to work well in practice, there are instances in which, for example, thresholds are not used in the door frames, or where the gap dimensions between the door edge and the adjacent frame are not uniform but of rather widely varying size, or in similar situations wherein it is necessary for the gasket to be expanded in size, along its complete extent or partially therealong, in order to effect a tight seal. It is to the solution of this type of problem, not solvable by fixed or standard maximum-dimension compressible tubular gaskets, flaps or similar mechanisms, that the invention, in one of its primary objectives, is directed.

A further object of the invention is to provide a novel method of and apparatus for closure sealing of more general applicability, as well.

The concept of expanding a gasket to fill the gaps between door edges and the frame, however, is not of itself broadly new. In the present assignee's U.S. Pat. No. 3,059,287, for example, a mechanical storage and linkage mechanism is provided within the door, activated by opening and closing of the same, to retract and expand peripheral gasket seals. While this type of structure is suitable for heavy and expensive closures, it is not adapted for simple light doors and similar closures, and certainly is not in any sense inexpensive. It is, therefore, in summary, to the more specific need for a simple automatically expanding and collapsing seal, operating upon the closing and opening of the door, respectively, and void of the necessity for mechanical linkages and other complex and costly constructions, that the invention is further particularly directed.

Other and further objects will be explained hereinafter and are more specifically set forth in the appended claims.

In summary, the invention, in its preferred form, contemplates compressing a region of a vertical tubular member adjacent the door mounting edge during closing of the door to pump air into a communicating horizontal tubular member disposed along the bottom edge of the door, to expand the same into a seal upon total closure of the door.

The invention will now be described with reference to the accompanying drawing,

FIG. 1 of which is a partial isometric view illustrating a preferred construction in the open position;

Figure 1:
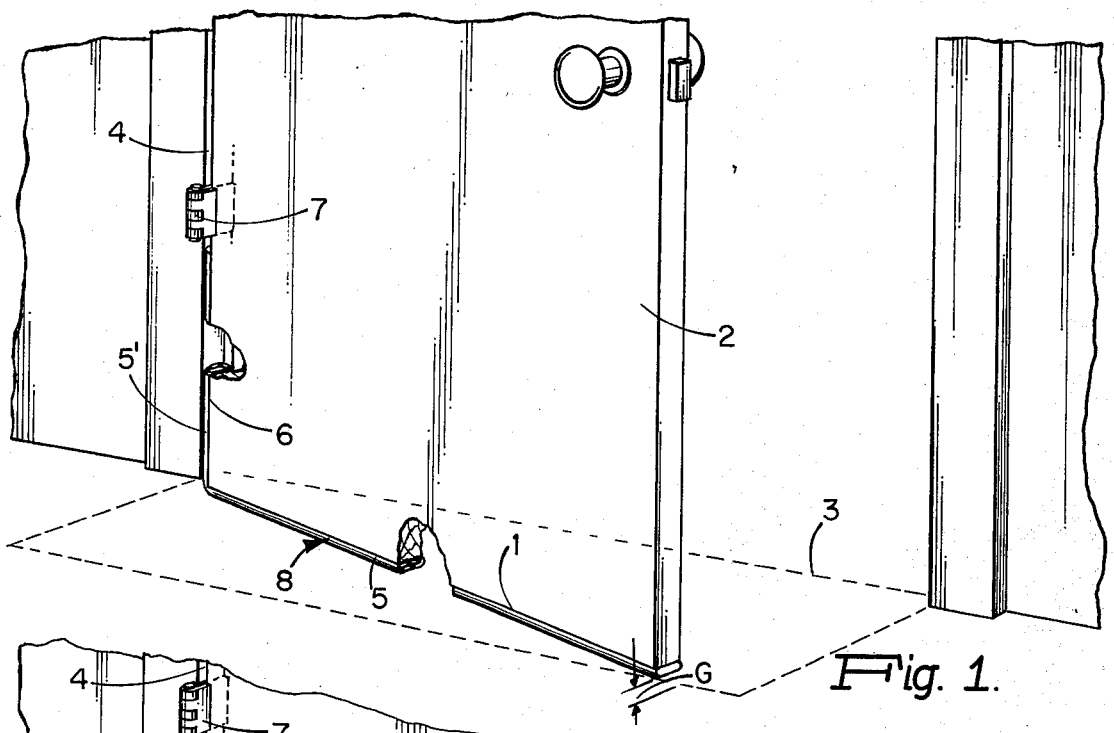
Figure 2:
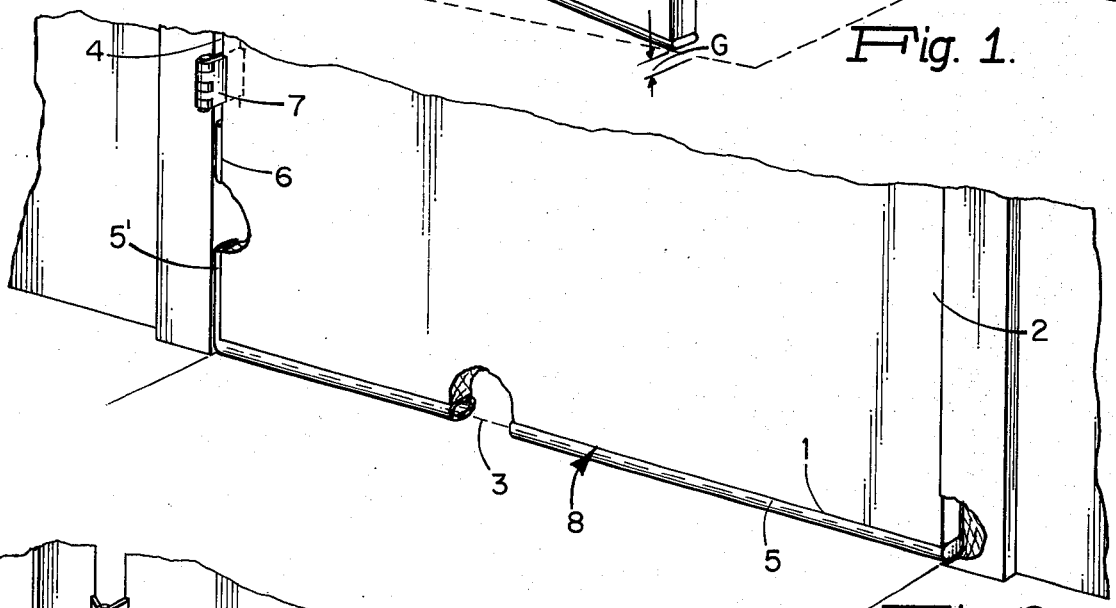
FIG. 2 is a similar view of the closed and sealed position.

Referring to FIG. 1, the invention is illustrated in connection with the sealing, for example, of the gap between the horizontal bottom edge 1 of a door 2 and the adjacent threshold bottom or floor defining the lower edge 3 of the door frame, the door being hingedly mounted at 7 along its vertical edge 6 to the adjacent vertical frame edge or side 4. An L-shaped resilient, sealed and air-tight tubular member 5 is shown disposed with its horizontal leg attached, as by a cement layer 8 or other securing means, along the bottom edge 1 of the door 2, and with a vertical leg or region 5′ similarly secured to the adjacent lower portion of the vertical door edge 6. The tubular member portions 5–5′ are illustrated in this case as of equal normal cross dimension or diameter, being formed from the same tube, though this is not essential. The frame bottom or floor 3, moreover, is spaced a gap distance G from the bottom of the horizontal tubular member 5, such that mere closure of the door 2 with the tubular member 5 retaining its normal cross-dimension, would not enable a seal. The spacing between the vertical edge 6 of the door and the adjacent edge 4 of the frame, however, is made less than the normal cross-dimension of the vertical tubular member region 5′ such that, when the door 2 starts to close, the vertical leg portion 5′ may start to become compressed. This compression pumps or forces the air therein into the uncompressed horizontal leg portion 5, expanding the same, as shown in FIG. 2. The relative volumes of the members 5 and 5′ are adjusted so that at complete or total closure, the horizontal tubular member leg 5 has been pumped up or expanded sufficiently to seal the gap G previously existing between the portion 5 and the floor 3.

Upon opening of the door 2, moreover, the expanded portion 5 resiliently collapses, returning air into the then released vertical tubular leg region 5′ and thus freeing the horizontal tubular member portion 5 from the floor bottom 3.

In a satisfactory apparatus installed on a hollow wood door, an increase in noise reduction of about 8 dB was obtained over the door alone and over the frequency range from 250 Hz to 4000 Hz, using a rubber-and-air type oval tubular member 1¼ inches by ⅜ inch in outside dimensions and about 0.040 inches in wall thickness, extending about 30 inches along a complete door bottom edge of the same length, and a comparable length of about 30 inches vertically upward at 5′. Upon closure of the door, the portion 5 was expanded from ⅜ inch to ⅝ inch in cross-dimension to effect the sealing action by the forcing of a volume of about 7 cubic inches of air normally in the portion 5′, into portion 5. The acoustical performance was limited by the performance of the hollow door, and greater noise reduction may be expected when installed on doors or panels having greater noise reduction capabilities.

Figure 3:
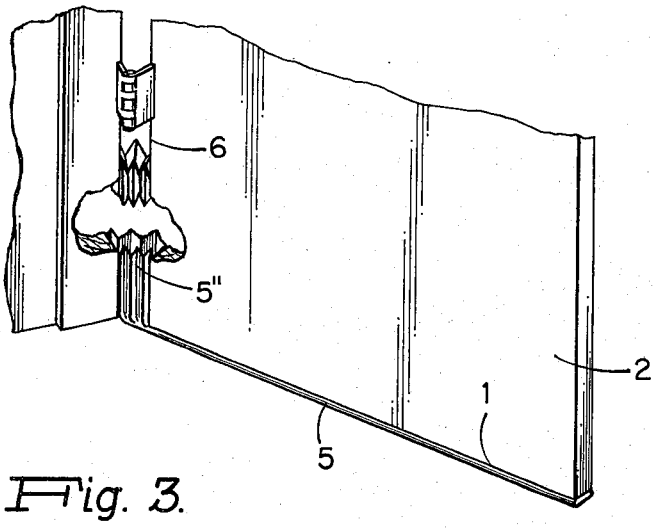
FIG. 3 is a fragmentary view of a modification.

If desired, the portion 5′ may be more elaborately formed into a hollow-type or similar air storage and compression or pump configuration, as shown at 5″ in FIG. 3, again resiliently expanded upon opening of the door and release of the pumped-up or expanded portion 5.

Further modifications will also occur to those skilled in this art and all such are considered to fall within the spirit and scope of the invention as defined in the appended claims.

What is claimed is:

1. Apparatus for acoustically sealing an edge such as the bottom edge of a closure such as a door that is mounted along a different edge thereof within a corresponding frame, with a greater gap between the bottom edge and the adjacent bottom of the frame than that between the mounting edge and its adjacent frame edge, the apparatus having, in combination a single-piece airtight L-shaped resilient tubular member of substantially uniform long-oval cross-section throughout its length mounted with its horizontal leg extending externally along the door bottom edge and its vertical leg extending externally along at least the adjacent region of the said mounting edge, the member being oriented so that the smaller cross-dimension of each leg is perpendicular to the associated edge, the tubular member horizontal leg having its normal smaller cross-dimension less than said greater gap and the vertical leg having its normal smaller cross-dimension sufficient to enable compression of the same against the said frame edge during closing of the door while the horizontal leg remains free of the said bottom of the frame, the relative length dimensions of the legs being adjusted such that the vertical leg contains sufficient air that, upon the said compression of the same, the horizontal leg may become pumped up into an expansion sufficient to seal the gap between it and the said bottom of the frame at total closing of the door.

2. Apparatus as claimed in claim 1 and in which said vertical leg is of length comparable to said horizontal leg.

* * * * *